US011573022B2

(12) United States Patent
Delgoshaei et al.

(10) Patent No.: US 11,573,022 B2
(45) Date of Patent: Feb. 7, 2023

(54) SOUND-BASED HVAC SYSTEM, METHOD AND DEVICE FOR DIAGNOSTICS ANALYSIS

(71) Applicant: Lennox Industries Inc., Richardson, TX (US)

(72) Inventors: Payam Delgoshaei, Addison, TX (US); Sridhar Venkatesh, Irving, TX (US); Glenn William Kowald, Carrollton, TX (US); Eric Berg, The Colony, TX (US); Janathkumar Manohararaj, McKinney, TX (US); Jeffrey Fontenault, McKinney, TX (US)

(73) Assignee: Lennox Industries Inc., Richardson, TX (US)

( * ) Notice: Subject to any disclaimer, the term of this patent is extended or adjusted under 35 U.S.C. 154(b) by 95 days.

(21) Appl. No.: 17/183,228

(22) Filed: Feb. 23, 2021

(65) Prior Publication Data

US 2022/0268469 A1 Aug. 25, 2022

(51) Int. Cl.

| | |
|---|---|
| ***F24F 11/38*** | (2018.01) |
| ***F24F 11/48*** | (2018.01) |
| ***F24F 11/52*** | (2018.01) |
| *F24F 130/40* | (2018.01) |

(52) U.S. Cl.

CPC ..... *F24F 11/38* (2018.01); *F24F 11/48* (2018.01); *F24F 11/52* (2018.01); *F24F 2130/40* (2018.01)

(58) Field of Classification Search

CPC .. F24F 11/38; F24F 11/48; F24F 11/52; F24F 2130/40

See application file for complete search history.

(56) References Cited

U.S. PATENT DOCUMENTS

| | | | | |
|---|---|---|---|---|
| 5,120,214 | A * | 6/1992 | West | F23N 5/16 431/12 |
| 11,193,683 | B2 * | 12/2021 | Venkatesh | F24F 11/64 |
| 11,333,378 | B1 * | 5/2022 | Limp | G05B 15/02 |
| 11,393,317 | B2 * | 7/2022 | Correnti | G08B 25/012 |
| 2013/0166051 | A1 * | 6/2013 | Eaton | F24F 11/30 700/94 |
| 2015/0168002 | A1 * | 6/2015 | Plitkins | F24F 11/30 165/268 |
| 2016/0364963 | A1 * | 12/2016 | Matsuoka | G06V 10/40 |
| 2018/0228006 | A1 * | 8/2018 | Baker | H05B 47/19 |
| 2019/0005953 | A1 * | 1/2019 | Bundalo | G06F 1/3287 |
| 2020/0073367 | A1 * | 3/2020 | Nguyen | G05B 19/4183 |
| 2021/0183406 | A1 * | 6/2021 | Rogers | G06N 7/005 |

(Continued)

*Primary Examiner* — Ramesh B Patel

(74) *Attorney, Agent, or Firm* — Baker Botts L.L.P.

(57) ABSTRACT

A device configured to operate a Heating, Ventilation, and Air Conditioning (HVAC) system and to receive an audio signal from a microphone while operating HVAC system. The device is further configured to generate a representation of the audio signal, to compare one or more audio signatures to the representation of the audio signal, and to determine that an audio signature from among the one or more audio signatures is not present within the representation of the audio signal. The device is further configured to determine a fault type that is associated with the audio signature that is not present within the representation of the audio signal, to identify a component identifier for a component of the HVAC system that is associated with fault type, and to output the component identifier.

20 Claims, 6 Drawing Sheets

(56) References Cited

U.S. PATENT DOCUMENTS

| | | | | |
|---|---|---|---|---|
| 2021/0199320 | A1* | 7/2021 | Venkatesh | G05B 13/0265 |
| 2021/0239831 | A1* | 8/2021 | Shin | G01S 13/88 |
| 2021/0335061 | A1* | 10/2021 | Claessens | G07C 5/0808 |
| 2021/0368279 | A1* | 11/2021 | Shayne | G10L 25/51 |
| 2021/0399911 | A1* | 12/2021 | Jorasch | H04L 65/403 |

* cited by examiner

SOUND-BASED HVAC SYSTEM, METHOD AND DEVICE FOR DIAGNOSTICS ANALYSIS

TECHNICAL FIELD

The present disclosure relates generally to Heating, Ventilation, and Air Conditioning (HVAC) system control, and more specifically to sound-based HVAC system diagnostics.

BACKGROUND

Existing heating, ventilation, and air conditioning (HVAC) systems typically can only provide a general alert when there is an issue with an HVAC system. For example, the HVAC system may report that an error has occurred while trying to operate the HVAC system and that a service is required to repair the HVAC system. Existing HVAC systems cannot typically self-diagnose any issues with the HVAC system. This means that a technician will need to inspect the HVAC system and make repairs to the HVAC system. In many instances, a technician will need to make multiple trips to a location to first diagnose the issue with an HVAC system and then to return with the appropriate parts and tools for servicing the HVAC system. This process results in an extended amount of downtime while the technician diagnoses and makes repairs to the HVAC system.

SUMMARY

The system disclosed in the present application provides a technical solution to the technical problems discussed above by providing a sound-based HVAC diagnostic system that is configured to detect faults and issues within an HVAC system based on sounds made by the components of the HVAC system. The disclosed system provides several practical applications and technical advantages which include a process that enables an HVAC system to self-diagnose faults within the HVAC system and to output information that identifies any faulty components of the HVAC system and/or instructions for servicing the HVAC system. These features reduce the amount of downtime that an HVAC system will experience because the HVAC system is able to output information that identifies the components that are causing the issues that the HVAC system is experiencing. This process allows a technician to be prepared with all of the necessary equipment (i.e. parts and tools) and instructions for servicing the HVAC system without having to first diagnose the HVAC system themselves.

In addition, existing HVAC systems rely on a manual inspection of an HVAC system for diagnosing issues and faulty components of the HVAC system. Such a manual process is susceptible to misdiagnosing issues with an HVAC system or overlooking some faulty components that may need replacing or servicing. The HVAC system may experience additional downtime when an HVAC system is misdiagnosed and/or not all of the correct components are serviced. In contrast, the self-diagnosing feature of the disclosed HVAC system ensures that the HVAC system will be correctly diagnosed and serviced at the outset which prevents further downtime for the HVAC system.

In one embodiment, the system comprises a device that is configured to operate an HVAC system and to receive an audio signal from one or more microphones while operating the HVAC system. The device is further configured to generate a representation of the audio signal and to compare one or more audio signatures to the representation of the audio signal. Each audio signature identifies one or more attributes for a portion of an audio signal. In addition, each audio signature is also associated with a fault type for the HVAC system. Each fault type is associated with a component identifier for a component of the HVAC system. The device is further configured to determine that an audio signature from among the one or more audio signatures is not present within the representation of the audio signal. The device is further configured to determine a fault type that is associated with the audio signature that is not present within the representation of the audio signal, to identify a component identifier for a component of the HVAC system that is associated with fault type, and to output the component identifier.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

System Overview

Figure 1:
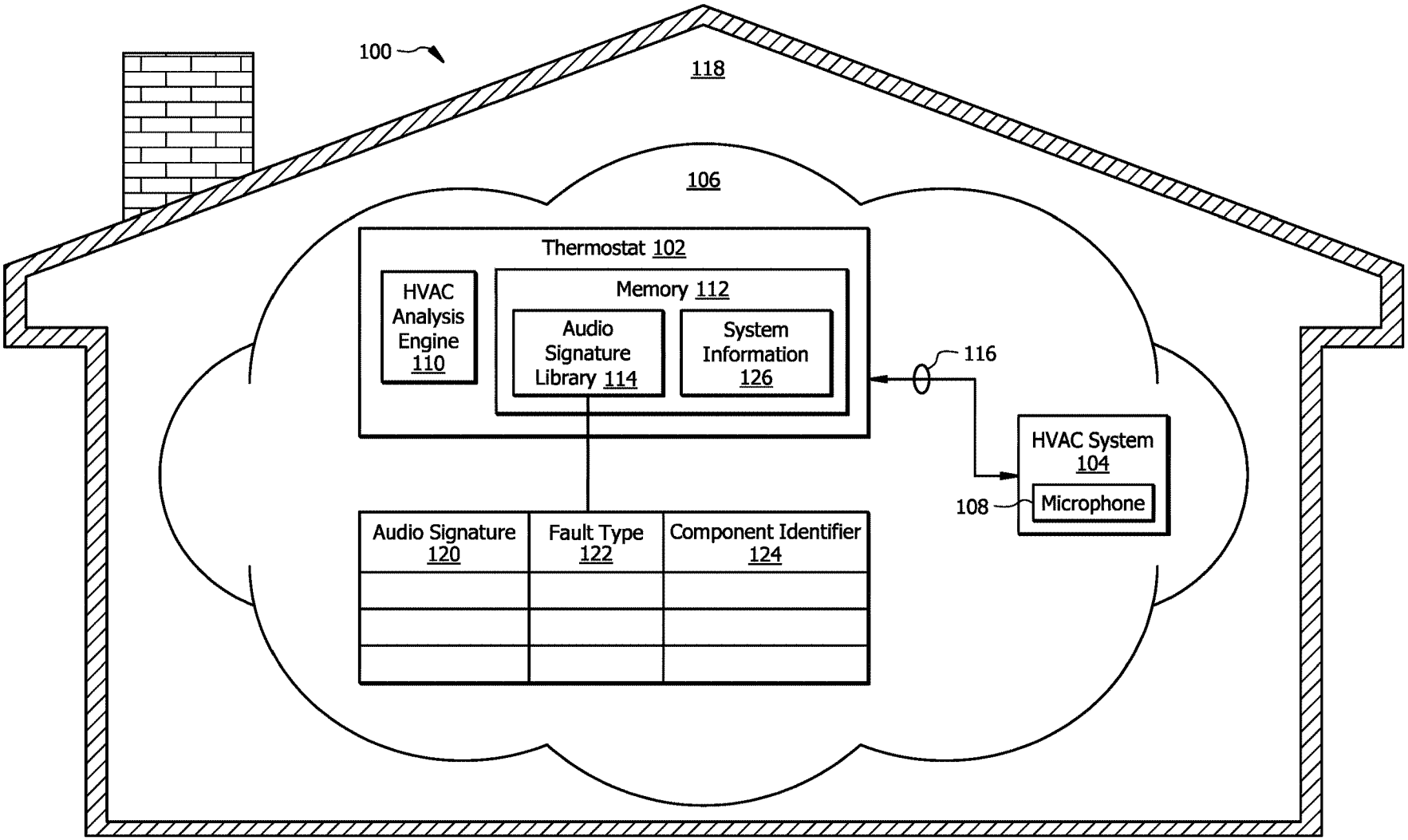
FIG. 1 is a schematic diagram of an embodiment of an analysis system for an HVAC system.

FIG. 1 is a schematic diagram of an embodiment of an analysis system 100 for heating, ventilation, and air conditioning (HVAC) systems 104. The analysis system 100 is generally configured to use sound for detecting and diagnosing faults within an HVAC system 104. More specifically, the analysis system 100 is configured to self-diagnose faults within the HVAC system 104 and to output information that identifies any faulty components of the HVAC system 104 and/or instructions for servicing the HVAC system 104. These features reduce the amount of downtime that an HVAC system 104 will experience because the HVAC system 104 is able to output information about the components that are causing the issues that the HVAC system 104 is experiencing. This process allows a technician to be prepared with all of the necessary equipment (i.e. parts and tools) and instructions for servicing the HVAC system 104 without having to first diagnose the HVAC system 104 themselves.

In one embodiment, the analysis system 100 comprises a thermostat 102, a microphone 108, and an HVAC system 104 that are in signal communication with each other over a network 106. The network 106 may be any suitable type of wireless and/or wired network including, but not limited to, all or a portion of the Internet, an Intranet, a private network, a public network, a peer-to-peer network, the public switched telephone network, a cellular network, a local area network (LAN), a metropolitan area network (MAN), a personal area network (PAN), a wide area network (WAN), and a satellite network. The network 106 may be configured to support any suitable type of communication protocol as would be appreciated by one of ordinary skill in the art.

HVAC System

An HVAC system 104 is generally configured to control the temperature of a space 118. Examples of a space 118 include, but are not limited to, a room, a home, an apartment, a mall, an office, a warehouse, or a building. The HVAC system 104 may comprise the thermostat 102, compressors, blowers, evaporators, condensers, and/or any other suitable type of hardware for controlling the temperature of the space 118. An example of an HVAC system 104 configuration and its components are described in more detail below in FIG. 6. Although FIG. 1 illustrates a single HVAC system 104, a location or space 118 may comprise a plurality of HVAC systems 104 that are configured to work together. For example, a large building may comprise multiple HVAC systems 104 that work cooperatively to control the temperature within the building.

Microphone

The analysis system 100 may comprise one or more microphones 108. The microphones 108 may be positioned at various locations within the HVAC system 104. The microphones 108 are generally configured to record the sounds that are made by electrical and mechanical components of the HVAC system 104. For example, a microphone 108 may be positioned proximate or adjacent to an integrated furnace control board, a relay, a compressor, a gas valve, a furnace, or any other component of the HVAC system 104. Each microphone is configured to capture audio signals 116 of one or more components of the HVAC system 104. A microphone 108 may be configured to capture audio signals 116 continuously, at predetermined intervals, or on-demand. Each microphone 108 is operably coupled to the HVAC analysis engine 110 and provides captured audio signals 116 to the HVAC analysis engine 110 for processing.

Thermostat

The thermostat 102 is generally configured to collect sound information for various components of the HVAC system 104 while operating the HVAC system 104 and to diagnosis faults within the HVAC system 104 based on the sound information. An example of the thermostat 102 in operation is described below in FIG. 2. In one embodiment, the thermostat 102 comprises an HVAC analysis engine 110 and a memory 112. The thermostat 102 may further comprise a graphical user interface, a display 508, a touch screen, buttons, knobs, or any other suitable combination of components. Additional details about the hardware configuration of the thermostat 102 are described in FIG. 5.

The HVAC analysis engine 110 is generally configured to control the operation of the HVAC system 104, to receive audio signals 116 from one or more microphones 108 of the components of the HVAC system 104 while the HVAC system 104 operates, and to detect and diagnose faults within the HVAC system 104 based on the audio signals 116. An example of the HVAC analysis engine 110 in operation is described in FIG. 2. In some embodiments, the HVAC analysis engine 110 may employ hardware resources from a remote or cloud server to process the audio signals 116 to detect and diagnose faults within the HVAC system 104.

The memory 112 is configured to store an audio signature library 114, system information 126, and/or any other suitable type of data. The audio signature library 114 comprises information that can be used with a visual representation (e.g. a plot or graph) of an audio signal 116 to determine whether a fault is present. For example, the audio signature library 114 may be configured to associate audio signatures 120 with fault types 122 and component identifiers 124. An audio signature 120 identifies attributes of an audio signal 116 that can be used to determine whether a fault is present within the HVAC system 104. Examples of audio signatures 120 include, but are not limited to, waveform profiles or patterns, frequency profiles or patterns, threshold values, or any other suitable type of information that can be used with a plot of an audio signal 116 to determine whether a fault is present. The fault type 122 identifies a particular type of issue that the HVAC is experiencing. Examples of fault types 122 include, but are not limited to, flame sensor faults, gas valve faults, blower faults, motor faults, relay faults, expansion valve faults, or any other suitable type of fault. Each fault type 122 is linked with a component identifier 124 that identifies a component of the HVAC system 104 that is causing the issue. The component identifier 124 may be a part name, a part number, a serial number, a model number, a barcode, or any other suitable type of alphanumeric identifier that uniquely identifies a component of the HVAC system 104. An example of using the audio signature library 114 is described below in steps 212 and 214 of FIG. 2.

The system information 126 comprises information that is associated with the components of the HVAC system 104. The system information 126 may comprise instructions for servicing components of the HVAC system 104, information about tools required for servicing components of the HVAC system 104, information about the physical locations of the components of the HVAC system 104, technical specifications for the components of the HVAC system 104, and/or any other suitable type of information that is associated with the components of the HVAC system 104.

Analysis Process for an HVAC System

Figure 2:
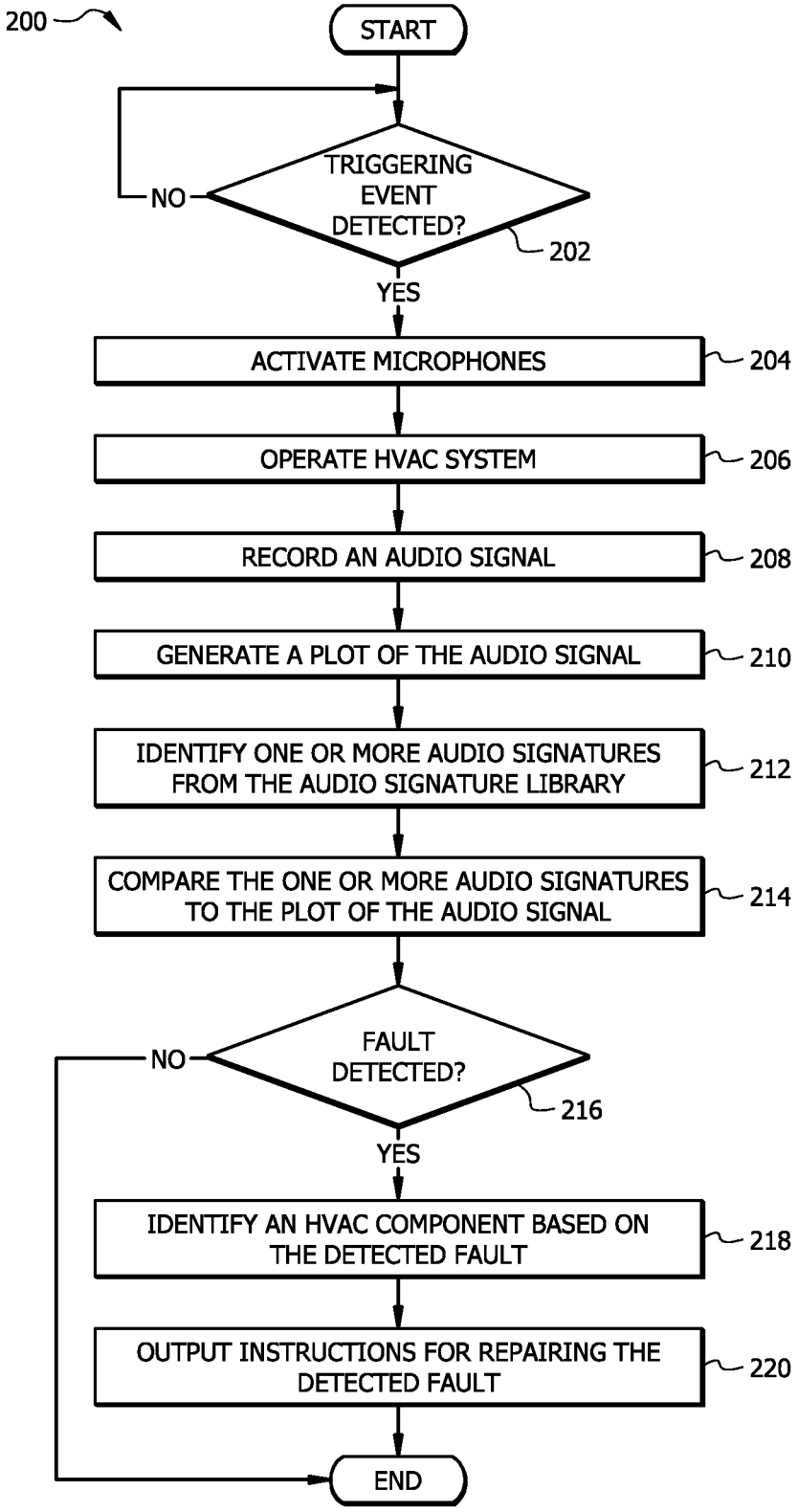
FIG. 2 is a flowchart of an embodiment of an analysis process for an HVAC system.

FIG. 2 is a flowchart of an embodiment of an analysis process 200 for an HVAC system 104. The analysis system 100 may employ process 200 to detect and diagnose faults within the HVAC system 104 while operating the HVAC system 104. Process 200 enables the analysis system 100 to self-diagnose faults within the HVAC system 104 and to output information that identifies any faulty components of the HVAC system 104 and/or instructions for servicing the HVAC system 104. This process reduces the amount of downtime that an HVAC system 104 will experience because the HVAC system 104 is able to output information about the components that are causing the issues that the HVAC system 104 is experiencing. This process allows a technician to be prepared with all of the necessary equipment (i.e. parts and tools) and instructions for servicing the HVAC system 104 without having to first diagnose the HVAC system 104 themselves.

At step 202, the thermostat 102 determines whether a triggering event has been detected. For example, the thermostat 102 may determine that a triggering event has occurred in response to detecting an error or fault with the HVAC system 104. In this example, the thermostat 102 may have previously sent instructions or commands to the HVAC system 104 to control the operation of the HVAC system 104. After sending the commands to the HVAC system 104, the thermostat 102 may determine that a fault has occurred while trying to operate the HVAC system 104. For instance, the thermostat 102 may receive an error message that indicates that the HVAC system 104 is unable to successfully execute the commands that were provided by the thermostat 102. As another example, the thermostat 102 may determine that a triggering event has occurred in response to receiving a user input to adjust the settings (e.g. setpoint temperature) of the HVAC system 104. In other examples, the thermostat 102 may detect any other suitable type of triggering event.

The thermostat 102 remains at step 202 in response to determining that a triggering event has not been detected yet. In this case, the thermostat 102 remains at step 202 to continue checking for a triggering event to execute the fault detection and diagnosis process for the HVAC system 104. The thermostat 102 proceeds to step 204 in response to determining that a triggering event has been detected. In this case, the thermostat 102 proceeds to step 204 to begin the fault detection and diagnosis process for the HVAC system 104.

At step 204, the thermostat 102 activates one or more microphones 108. Here, the thermostat 102 activates one or more microphones 108 by transitioning the microphones 108 from an inactive state to an active state. In the inactive state, the microphones 108 are not configured to capture audio signals 116 or to send audio signals 116 to the thermostat 102 for processing. In the active state, the microphones 108 are configured to capture audio signals 116 and to send audio signals 116 to the thermostat 102 for processing.

At step 206, the thermostat 102 operates the HVAC system 104. Here, the thermostat 102 sends instructions or commands to the HVAC system 104 to control the operation of the HVAC system 104. For example, the thermostat 102 may send commands to increase the heating or cooling within a space 118 to change the setpoint temperature for the space 118.

At step 208, the thermostat 102 records an audio signal 116 while operating the HVAC system 104. The thermostat 102 uses the microphones 108 to capture an audio signal 116 of the components of the HVAC system 104 while the HVAC system 104 is operating or while the HVAC system 104 attempts to execute the commands that were provided by the thermostat 102. The thermostat 102 may be configured to capture the audio signal 116 for any suitable duration of time. In some embodiments, the thermostat 102 may combine audio signals from multiple microphones that are distributed within the HVAC system 104 to form an aggregated audio signal 116. This process allows the thermostat 102 to collect and use sound information for more components of the HVAC system 104.

Figure 3:
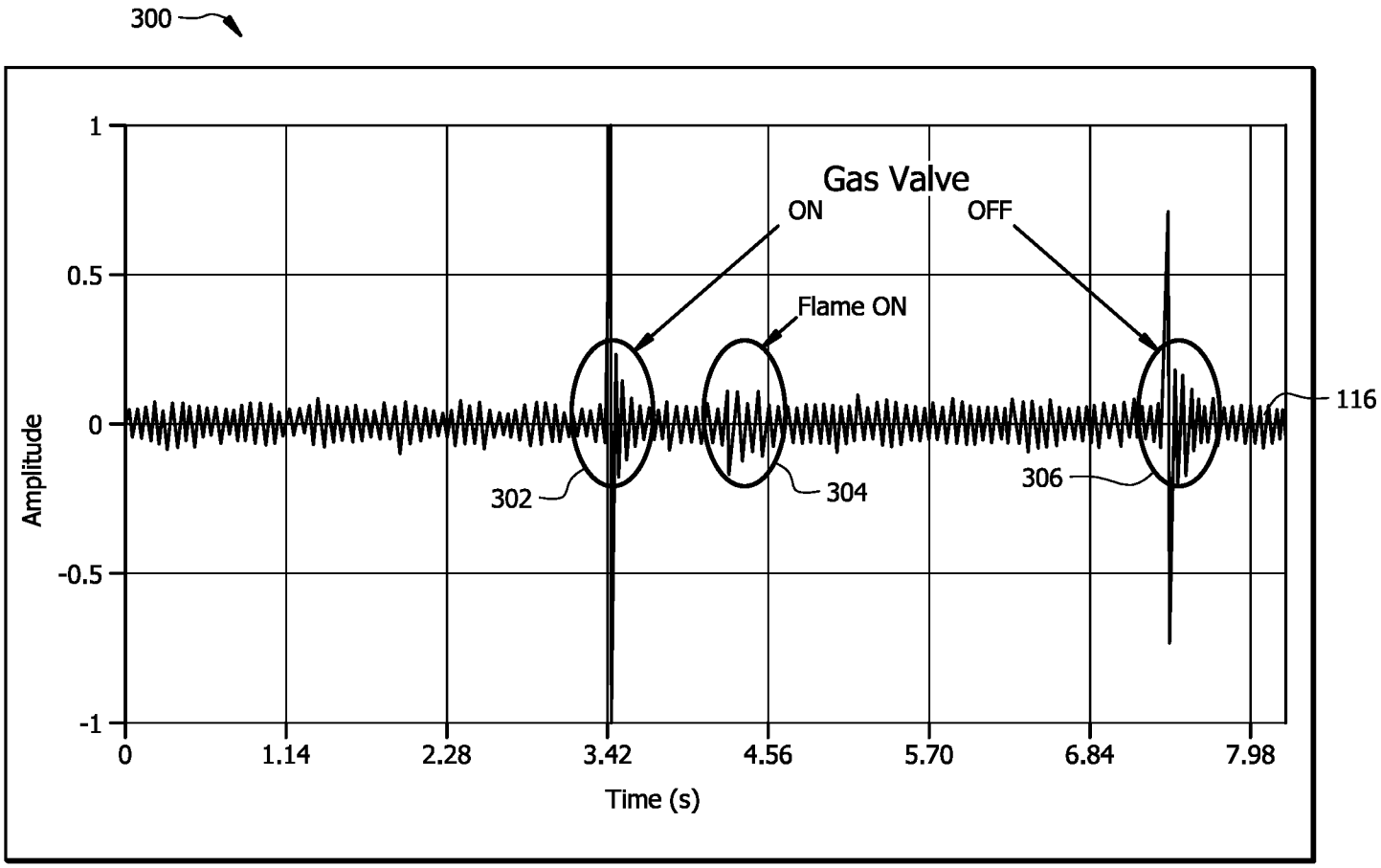
FIG. 3 is an example of a plot of an audio signal.

At step 210, the thermostat 102 generates a plot of the audio signal 116. The thermostat 102 may generate any suitable type of graphical or visual representation of the audio signal 116 that can be used for detecting and diagnosing faults within the HVAC system 104. Referring to the example shown in FIG. 3, the thermostat 102 may generate a plot 300 of amplitudes for the audio signal 116 over time. In this example, the audio signal 116 includes audio samples for when a gas valve is turned on, a flame is turned on, and the gas valve is turned off. In other examples, the audio signal 116 may comprise audio samples that are associated with the operation of any other components of the HVAC system 104.

Figure 4:
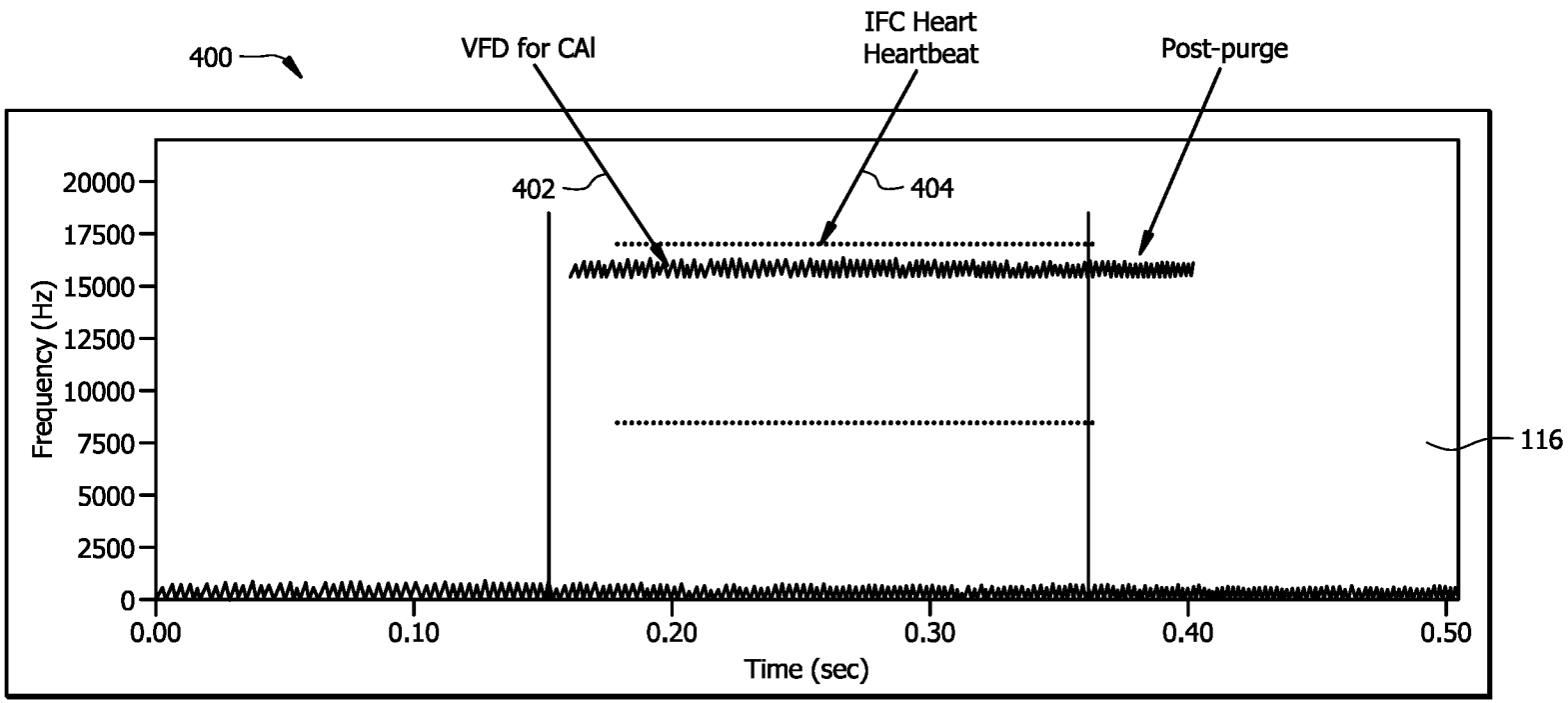
FIG. 4 is another example of a plot of an audio signal.

Referring to the example shown in FIG. 4, the thermostat 102 may generate a plot 400 (e.g. a spectrogram) of frequencies for the audio signal 116 over time. For example, the thermostat 102 may apply a Fast Fourier Transformation (FFT) to the audio signal 116 to generate the spectrogram or plot 400 of the frequencies for the audio signal 116 over time. In this example, the audio signal 116 includes audio samples for the operation of a variable frequency drive (VFD) for a combustion air inducer (CAI), an integrated furnace control (IFC) heartbeat, and a post-purge operation for a VFD. In other examples, the audio signal 116 may comprise audio samples that are associated with the operation of any other components of the HVAC system 104.

Returning to FIG. 2 at step 212, the thermostat 102 identifies one or more audio signatures 120 from the audio signature library 114. For example, the thermostat 102 may identify audio signatures 120 from the audio signature library 114 based on the commands that the thermostat 102 uses to control the operation of the HVAC system 104. In this example, the thermostat 102 may identify the audio signatures 120 that are associated with the components of the HVAC system 104 that are used to perform the requested operation from the thermostat 102. As another example, the thermostat 102 may identify audio signatures 120 that are associated with a previously detected fault when operating the HVAC system 104. As another example, the thermostat 102 may identify audio signatures 120 that are commonly associated with faults of the HVAC system 104. In other examples, the thermostat 102 may use any other suitable criteria for identifying audio signatures 120.

At step 214, the thermostat 102 compares the one or more audio signatures 120 to the plot of the audio signal 116. The thermostat 102 may compare the attributes of each audio signature 120 to at least a portion of the visual representation of the audio signal 116 to determine whether the audio signature 120 is present within the audio signal 116.

At step 216, the thermostat 102 determines whether a fault was detected based on the comparison. In one embodiment, the thermostat 102 may be configured to detect a fault when an audio signature 120 is not present within the plot of the audio signal 116. In this case, the audio signatures 120 correspond with attributes that should be present in the plot of the audio signal 116 when the components of the HVAC system 104 are operating normally. Referring to the example in FIG. 3, the thermostat 102 may compare an audio signature 302 that corresponds with a gas valve being turned on, an audio signature 304 that corresponds with a flame being turned on, and an audio signature 306 that corresponds with the gas valve being turned off to the plot 300 of the audio signal 116. The thermostat 102 uses the audio signatures 120 to determine whether the components (i.e. the gas valve and the ignitor) of the HVAC system 104 are operating normally or as expected. In this example, the thermostat 102 may detect a fault associated with the gas valve in response to determining that one or more of the audio signatures 120 that are associated with the gas valve (e.g. audio signatures 302 and 306) are not present or are distorted in the audio signal 116. In this example, the audio signatures 302 and 306 correspond with attributes that should be present in the plot 300 of the audio signal 116 when the gas valve is operating normally. This means that the thermostat 102 can determine that the gas valve likely has a fault or issue when the audio signatures 302 and 306 are not present or are distorted. Similarly, the audio signature 304 may correspond with attributes that should be present in the plot 300 of the audio signal 116 when the ignitor is operating normally. This means that the thermostat 102 can determine that the ignitor likely has a fault or issue when the audio signature 304 is not present or is distorted.

As another example, the thermostat 102 may be configured to detect a fault when an audio signature 120 is present within the audio signal 116. In this case, the audio signatures 120 correspond with attributes of a fault that should not be present when the components of the HVAC system 104 are operating normally. This configuration allows the thermostat 102 to detect components that likely have a fault or issue when one or more audio signatures 120 are present within the plot of the audio signal 116. For example, the thermostat 102 may detect a fault that is associated with the gas valve when an audio signature 120 that is associated with a gas valve fault is present within the plot of the audio signal 116.

As another example, an audio signature 120 may correspond with a threshold value (e.g. a maximum amplitude value or a minimum amplitude value). In this example, the thermostat 102 may use threshold values to detect faults. For instance, the thermostat 102 may detect a fault that is associated with the gas valve when the amplitude of the audio signal 116 exceeds the threshold value that is identified by the audio signature 120.

As another example, the thermostat 102 may detect a fault based on the presence or absence of specific frequencies within the plot of the audio signal 116. In this case, an audio signature 120 may correspond with a particular frequency value. The thermostat 102 uses the audio signatures 120 to determine whether the frequency values are present within the plot of the audio signal 116. Referring to the example in FIG. 4, the thermostat 102 may compare an audio signature 402 that corresponds with the operation of the VFD for the CAI and an audio signature 404 that corresponds with integrated furnace controller heartbeat to the plot 400 of the audio signal 116. In this example, the audio signatures 402 and 404 correspond with attributes that should be present in the plot 400 of the audio signal 116 when the VFD for the CAI and the integrated furnace controller are operating normally. This process allows the thermostat 102 to determine that the VFD for the CAI or the integrated furnace controller likely has a fault or issue when the audio signatures 402 and 404 are not present or are distorted, respectively. In other examples, the thermostat 102 may use the audio signatures 120 to detect a fault when the audio signatures 120 are present within the plot 400 of the audio signal 116 using a process similar to the process described above.

In some embodiments, the thermostat 102 may be configured to detect a fault by analyzing the frequency content of the audio signal 116. For example, the thermostat 102 may perform a Fast Fourier Transformation on the audio signal 116 to identify the frequency content of the audio signal 116. The thermostat 102 may then determine whether one or more predetermined frequencies are present within the frequency content of the audio signal 116. In this example, the thermostat 102 may detect a fault when one or more of the predetermined frequencies is not present within the frequency content of the audio signal 116. In some embodiments, the thermostat 102 may use this process without generating a visual representation (e.g. a plot) of the audio signal 116.

The thermostat 102 terminates process 200 in response to determining that a fault was not detected. In this case, the thermostat 102 determines that the HVAC system 104 is operating as expected and that there are no issues with the HVAC system 104 to diagnose. Otherwise, the thermostat 102 proceeds to step 218 in response to determining that a fault was detected. In this case, the thermostat 102 determines that one or more components of the HVAC system 104 may have an issue and proceeds to step 218 to identify the components that should be inspected or serviced.

At step 218, the thermostat 102 identifies an HVAC component based on the detected fault. Here, the thermostat 102 first identifies the audio signature 120 or fault type 122 that corresponds with a detected fault. The thermostat 102 then identifies the component of the HVAC system 104 based on the identified audio signature 120 or fault type 122. For example, the thermostat 102 may use the mapping from the audio signature library 114 to identify component identifiers 124 that are associated with a particular audio signature 120 or fault type 122.

At step 220, the thermostat 102 outputs instructions for repairing the detected fault. After detecting a fault, the thermostat 102 may output information about the components of the HVAC system 104 that are associated with the fault and/or any other information that can be used to service the HVAC system 104. For example, the thermostat 102 may output a component identifier 124 for any components that are associated with the detected fault, location information about where the identified components are located within the HVAC system 104, service instructions for how to repair or replace the identified components, tools for servicing the identified components, and/or any other suitable type of information that is associated with the identified components of the HVAC system 104.

In one example, the thermostat 102 may output a component identifier 124 for one or more components of the HVAC system 104 and other information that is associated with the identified components by displaying the information on a graphical user interface (e.g. display 508) of the thermostat 102. In this example, the thermostat 102 allows a user to identify the causes for a fault locally by interacting with the graphical user interface of the thermostat 102. The information associated with the fault may also be accessible from a user device that is configured to communicate with the thermostat 102. For instance, a user may be able to access the information that is associated with the fault using a mobile application or an Internet browser on a user device.

In another example, the thermostat 102 may output a component identifier 124 for one or more components of the HVAC system 104 and other information that is associated with the identified components by sending the information to a device that is located outside of the space. In this example, the thermostat 102 allows a user to identify the causes for a fault remotely. For instance, the thermostat 102 may send the component identifiers 124 and other information to a user device of a technician that will service the HVAC system 104. This process allows the technician to obtain information about the components that need to be serviced or replaced before the technician arrives to the space 118. This feature reduces the downtime of the HVAC system 104 by providing diagnostic information to the technician before the technician arrives which reduces the amount of time required to diagnose issues with the HVAC system 104 and to service the HVAC system 104.

Hardware Configuration for an Adaptive Control Device

Figure 5:
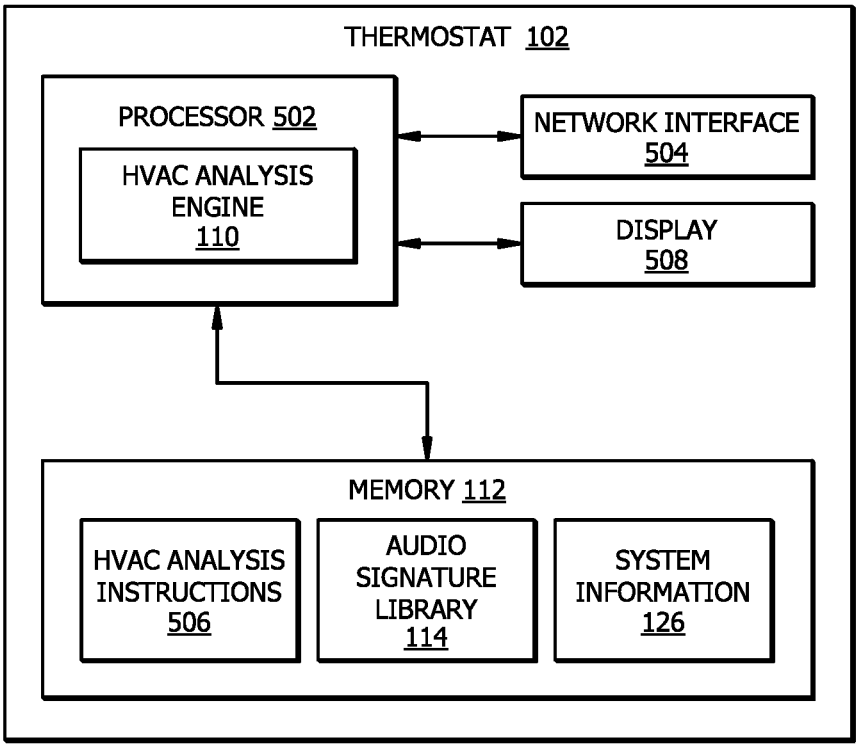
FIG. 5 is an embodiment of an analysis device for the HVAC system.

FIG. 5 is an embodiment of an analysis device (e.g. thermostat 102) of an analysis system 100. As an example, the thermostat 102 comprises a processor 502, a memory 112, and a network interface 504. The thermostat 102 may be configured as shown or in any other suitable configuration.

Processor

The processor 502 comprises one or more processors operably coupled to the memory 112. The processor 502 is any electronic circuitry including, but not limited to, state machines, one or more central processing unit (CPU) chips, logic units, cores (e.g. a multi-core processor), field-programmable gate array (FPGAs), application-specific integrated circuits (ASICs), or digital signal processors (DSPs). The processor 502 may be a programmable logic device, a microcontroller, a microprocessor, or any suitable combination of the preceding. The processor 502 is communicatively coupled to and in signal communication with the memory 112, display 508, microphones 108, and the network interface 504. The one or more processors are configured to process data and may be implemented in hardware or software. For example, the processor 502 may be 8-bit, 16-bit, 32-bit, 64-bit, or of any other suitable architecture. The processor 502 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components.

The one or more processors are configured to implement various instructions. For example, the one or more processors are configured to execute HVAC analysis instructions 506 to implement the HVAC analysis engine 110. In this way, processor 502 may be a special-purpose computer designed to implement the functions disclosed herein. In an embodiment, the HVAC analysis engine 110 is implemented using logic units, FPGAs, ASICs, DSPs, or any other suitable hardware. The HVAC analysis engine 110 is configured to operate as described in FIGS. 1 and 2. For example, the HVAC analysis engine 110 may be configured to perform the steps of process 200 as described in FIG. 2.

Memory

The memory 112 is operable to store any of the information described above with respect to FIGS. 1 and 2 along with any other data, instructions, logic, rules, or code operable to implement the function(s) described herein when executed by the processor 502. The memory 112 comprises one or more disks, tape drives, or solid-state drives, and may be used as an over-flow data storage device, to store programs when such programs are selected for execution, and to store instructions and data that are read during program execution. The memory 112 may be volatile or non-volatile and may comprise a read-only memory (ROM), random-access memory (RAM), ternary content-addressable memory (TCAM), dynamic random-access memory (DRAM), and static random-access memory (SRAM).

The memory 112 is operable to store HVAC analysis instructions 506, an audio signature library 114, system information 126, and/or any other data or instructions. The HVAC analysis instructions 506 may comprise any suitable set of instructions, logic, rules, or code operable to execute the HVAC analysis engine 110. The audio signature library 114 and the system information 126 configured similar to the audio signature library 114 and the system information 126 described in FIGS. 1 and 2, respectively.

Display

The display 508 is a graphical user interface that is configured to present visual information to a user using graphical objects. Examples of the display 508 include, but are not limited to, a liquid crystal display (LCD), a liquid crystal on silicon (LCOS) display, a light-emitting diode (LED) display, an active-matrix OLED (AMOLED), an organic LED (OLED) display, a projector display, or any other suitable type of display as would be appreciated by one of ordinary skill in the art.

Network Interface

The network interface 504 is configured to enable wired and/or wireless communications. The network interface 504 is configured to communicate data between the thermostat 102 and other devices (e.g. microphones 108 and the HVAC system 104), systems, or domains. For example, the network interface 504 may comprise an NFC interface, a Bluetooth interface, a Zigbee interface, a Z-wave interface, an RFID interface, a WIFI interface, a LAN interface, a WAN interface, a PAN interface, a modem, a switch, or a router. The processor 502 is configured to send and receive data using the network interface 504. The network interface 504 may be configured to use any suitable type of communication protocol as would be appreciated by one of ordinary skill in the art.

HVAC System Configuration

Figure 6:
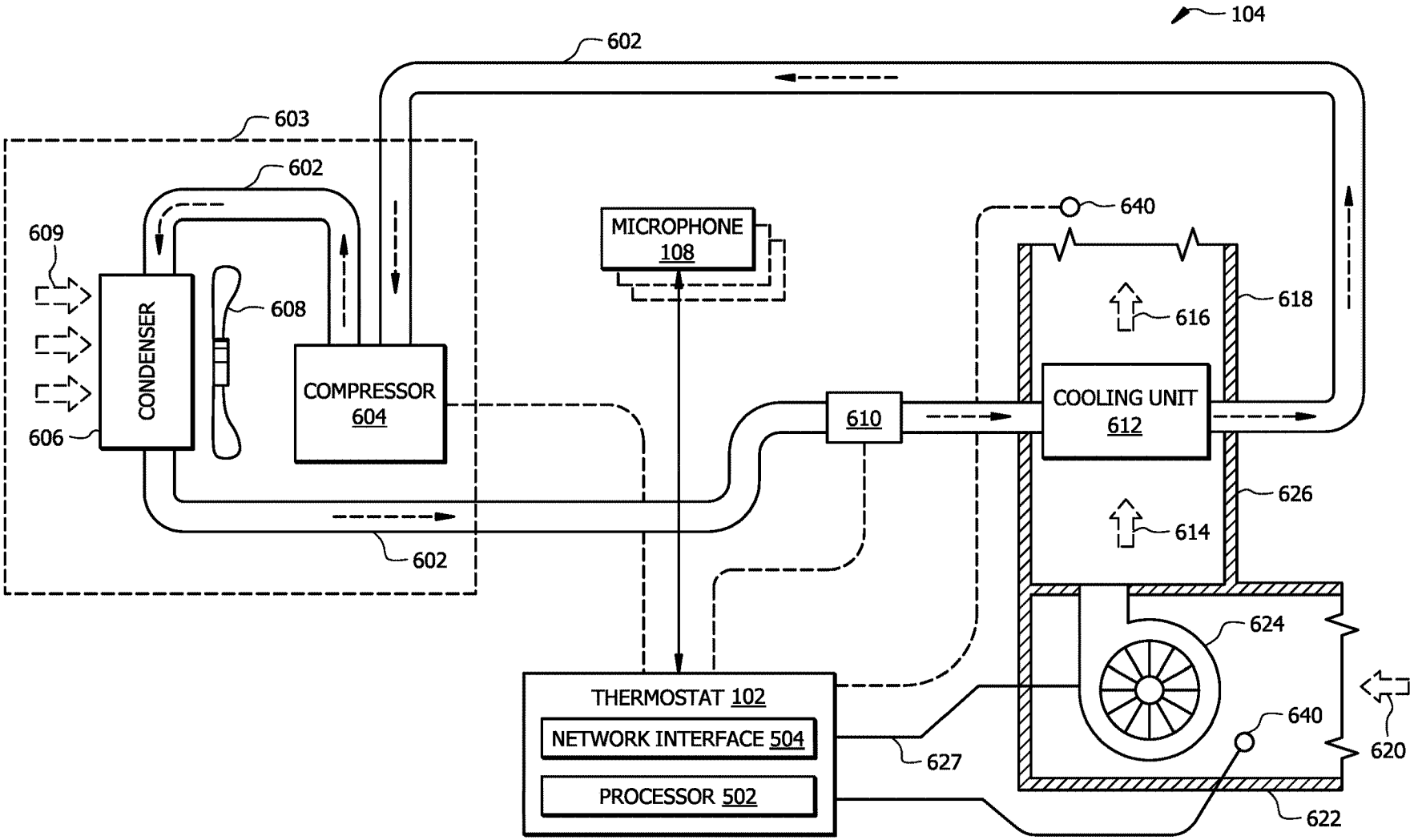
FIG. 6 is a schematic diagram of an embodiment of an HVAC system configured to integrate with the analysis system.

FIG. 6 is a schematic diagram of an embodiment of an HVAC system 104 configured to integrate with an analysis system 100. The HVAC system 104 conditions air for delivery to an interior space of a building or home. In some embodiments, the HVAC system 104 is a rooftop unit (RTU) that is positioned on the roof of a building and the conditioned air is delivered to the interior of the building. In other embodiments, portions of the system may be located within the building and a portion outside the building. The HVAC system 104 may also include heating elements that are not shown here for convenience and clarity. The HVAC system 104 may be configured as shown in FIG. 6 or in any other suitable configuration. For example, the HVAC system 104 may include additional components or may omit one or more components shown in FIG. 6.

The HVAC system 104 comprises a working-fluid conduit subsystem 602 for moving a working fluid, or refrigerant, through a cooling cycle. The working fluid may be any acceptable working fluid, or refrigerant, including, but not limited to, fluorocarbons (e.g. chlorofluorocarbons), ammonia, non-halogenated hydrocarbons (e.g. propane), hydrofluorocarbons (e.g. R-410A), or any other suitable type of refrigerant.

The HVAC system 104 comprises one or more condensing units 603. In one embodiment, the condensing unit 603 comprises a compressor 604, a condenser coil 606, and a fan 608. The compressor 604 is coupled to the working-fluid conduit subsystem 602 that compresses the working fluid. The condensing unit 603 may be configured with a single-stage or multi-stage compressor 604. A single-stage compressor 604 is configured to operate at a constant speed to increase the pressure of the working fluid to keep the working fluid moving along the working-fluid conduit subsystem 602. A multi-stage compressor 604 comprises multiple compressors configured to operate at a constant speed to increase the pressure of the working fluid to keep the working fluid moving along the working-fluid conduit subsystem 602. In this configuration, one or more compressors can be turned on or off to adjust the cooling capacity of the HVAC system 104. In some embodiments, a compressor 604 may be configured to operate at multiple speeds or as a variable speed compressor. For example, the compressor 604 may be configured to operate at multiple predetermined speeds.

In one embodiment, the condensing unit 603 (e.g. the compressor 604) is in signal communication with a controller or thermostat 102 using a wired or wireless connection. The thermostat 102 is configured to provide commands or signals to control the operation of the compressor 604. For example, the thermostat 102 is configured to send signals to turn on or off one or more compressors 604 when the condensing unit 603 comprises a multi-stage compressor 604. In this configuration, the thermostat 102 may operate the multi-stage compressors 604 in a first mode where all the compressors 604 are on and a second mode where at least one of the compressors 604 is off. In some examples, the thermostat 102 may be configured to control the speed of the compressor 604.

The condenser 606 is configured to assist with moving the working fluid through the working-fluid conduit subsystem 602. The condenser 606 is located downstream of the compressor 604 for rejecting heat. The fan 608 is configured to move air 609 across the condenser 606. For example, the fan 608 may be configured to blow outside air through the heat exchanger to help cool the working fluid. The compressed, cooled working fluid flows downstream from the condenser 606 to an expansion device 610, or metering device.

The expansion device 610 is configured to remove pressure from the working fluid. The expansion device 610 is coupled to the working-fluid conduit subsystem 602 downstream of the condenser 606. The expansion device 610 is closely associated with a cooling unit 612 (e.g. an evaporator coil). The expansion device 610 is coupled to the working-fluid conduit subsystem 602 downstream of the condenser 606 for removing pressure from the working fluid. In this way, the working fluid is delivered to the cooling unit 612 and receives heat from airflow 614 to produce a treated airflow 616 that is delivered by a duct subsystem 618 to the desired space, for example, a room in the building.

A portion of the HVAC system 104 is configured to move air across the cooling unit 612 and out of the duct subsystem 618. Return air 620, which may be air returning from the building, fresh air from outside, or some combination, is pulled into a return duct 622. A suction side of a variable-speed blower 624 pulls the return air 620. The variable-speed blower 624 discharges airflow 614 into a duct 626 from where the airflow 614 crosses the cooling unit 612 or heating elements (not shown) to produce the treated airflow 616.

Examples of a variable-speed blower 624 include, but are not limited to, belt-drive blowers controlled by inverters, direct-drive blowers with electronically commutated motors (ECM), or any other suitable types of blowers. In some configurations, the variable-speed blower 624 is configured to operate at multiple predetermined fan speeds. In other configurations, the fan speed of the variable-speed blower 624 can vary dynamically based on a corresponding temperature value instead of relying on using predetermined fan speeds. In other words, the variable-speed blower 624 may be configured to dynamically adjust its fan speed over a range of fan speeds rather than using a set of predetermined fan speeds. This feature also allows the thermostat 102 to gradually transition the speed of the variable-speed blower 624 between different operating speeds. This contrasts with conventional configurations where a variable-speed blower 624 is abruptly switched between different predetermined fan speeds. The variable-speed blower 624 is in signal communication with the thermostat 102 using any suitable type of wired or wireless connection 627. The thermostat 102 is configured to provide commands or signals to the variable-speed blower 624 to control the operation of the variable-speed blower 624. For example, the thermostat 102 is configured to send signals to the variable-speed blower 624 to control the fan speed of the variable-speed blower 624. In some embodiments, the thermostat 102 may be configured to send other commands or signals to the variable-speed blower 624 to control any other functionality of the variable-speed blower 624.

The HVAC system 104 comprises one or more sensors 640 in signal communication with the thermostat 102. The sensors 640 may comprise any suitable type of sensor for measuring the air temperature. The sensors 640 may be positioned anywhere within a conditioned space (e.g. a room or building) and/or the HVAC system 104. For example, the HVAC system 104 may comprise a sensor 640 positioned and configured to measure an outdoor air temperature. As another example, the HVAC system 104 may comprise a sensor 640 positioned and configured to measure a supply or treated air temperature and/or a return air temperature. In other examples, the HVAC system 104 may comprise sensors 640 positioned and configured to measure any other suitable type of air temperature.

The HVAC system 104 comprises one or more thermostats 102, for example, located within a conditioned space (e.g. a room or building). A thermostat 102 may be a single-stage thermostat, a multi-stage thermostat, or any suitable type of thermostat as would be appreciated by one of ordinary skill in the art. The thermostat is configured to allow a user to input a desired temperature or temperature set point for a designated space or zone such as the room.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A Heating, Ventilation, and Air Conditioning (HVAC) analysis system, comprising:

a microphone positioned adjacent to one or more components of an HVAC system, wherein the one or more components of the HVAC system are configured to perform an operation that changes a temperature within a space, and wherein the microphone is configured to capture an audio signal of the one or more components of the HVAC system; and an analysis device operably coupled to the microphone, comprising:

a memory operable to store an audio signature library comprising a plurality of audio signatures, wherein:

each audio signature identifies one or more attributes for a portion of an audio signal;

each audio signature is associated with a fault type for the HVAC system; and each fault type is associated with a component identifier for a component of the HVAC system; and a processor operably coupled to the memory, configured to:

send to the HVAC system instructions to perform the operation;

receive a first audio signal from the microphone while the HVAC system performs the operation;

generate a representation of the first audio signal;

identify one or more audio signatures from the audio signature library, wherein the one or more audio signatures are associated with the one or more components of the HVAC system;

compare the one or more audio signatures to the representation of the first audio signal;

determine that an audio signature from among the one or more audio signatures is not present within the representation of the first audio signal;

determine a fault type that is associated with the audio signature that is not present within the representation of the first audio signal;

identify a first component identifier for a first component of the HVAC system that is associated with the fault type; and output the first component identifier.

2. The system of claim 1, wherein the processor is further configured to transition the microphone from an inactive state to an active state before operating the HVAC system, wherein:

the microphone is not configured to capture the first audio signal while in the inactive state; and the microphone is configured to capture the first audio signal while in the active state.

3. The system of claim 1, wherein the processor is further configured to:

detect a triggering event corresponding with a first fault for the HVAC system while operating the HVAC system; and transition the microphone from an inactive state to an active state in response to the triggering event, wherein:

the microphone is not configured to capture the first audio signal while in the inactive state; and the microphone is configured to capture the first audio signal while in the active state.

4. The system of claim 1, wherein the representation of the first audio signal is a plot of amplitude over time for the first audio signal.

5. The system of claim 1, wherein the representation of the first audio signal is a plot of frequencies over time for the first audio signal.

6. The system of claim 1, wherein outputting the first component identifier comprises displaying the first component identifier on a graphical user interface.

7. The system of claim 1, wherein outputting the first component identifier comprises sending the first component identifier to a device that is located outside of the space.

8. The system of claim 1, wherein:

the memory is further operable to store instructions for servicing the components of the HVAC system; and the processor is further configured to output instructions for servicing the first component of the HVAC system that is associated with the first component identifier.

9. A Heating, Ventilation, and Air Conditioning (HVAC) analysis method, comprising:

sending to an HVAC system instructions to perform an operation that changes a temperature within a space, wherein the HVAC system comprises one or more components configured toperform the operation;

receiving a first audio signal from a microphone while the HVAC system performs the operation;

generating a representation of the first audio signal, wherein:

the microphone is positioned adjacent to the one or more components of the HVAC system; and the microphone is configured to capture the first audio signal of the one or more components of the HVAC system;

identifying one or more audio signatures from an audio signature library, wherein the one or more audio signatures are associated with the one or more components of the HVAC system;

comparing the one or more audio signatures to the representation of the first audio signal, wherein:

each audio signature identifies one or more attributes for a portion of an audio signal;

each audio signature is associated with a fault type for the HVAC system; and each fault type is associated with a component identifier for a component of the HVAC system;

determining that an audio signature from among the one or more audio signatures is not present within the representation of the first audio signal;

determining a fault type that is associated with the audio signature that is not present within the representation of the first audio signal;

identifying a first component identifier for a first component of the HVAC system that is associated with the fault type; and outputting the first component identifier.

10. The method of claim 9, further comprising transitioning the microphone from an inactive state to an active state before operating the HVAC system, wherein:

the microphone is not configured to capture the first audio signal while in the inactive state; and the microphone is configured to capture the first audio signal while in the active state.

11. The method of claim 9, further comprising:

detecting a triggering event corresponding with a first fault for the HVAC system while operating the HVAC system; and transitioning the microphone from an inactive state to an active state in response to the triggering event, wherein:

the microphone is not configured to capture the first audio signal while in the inactive state; and the microphone is configured to capture the first audio signal while in the active state.

12. The method of claim 9, wherein the representation of the audio signal is a plot of amplitude over time for the first audio signal.

13. The method of claim 9, wherein the representation of the audio signal is a plot of frequencies over time for the first audio signal.

14. The method of claim 9, wherein outputting the first component identifier comprises displaying the first component identifier on a graphical user interface.

15. The method of claim 9, wherein outputting the first component identifier comprises sending the first component identifier to a device that is located outside of the space.

16. The method of claim 9, further comprising outputting instructions for servicing the first component of the HVAC system that is associated with the first component identifier.

17. A Heating, Ventilation, and Air Conditioning (HVAC) analysis device, comprising:

a memory operable to store an audio signature library comprising a plurality of audio signatures, wherein:

each audio signature identifies one or more attributes for a portion of an audio signal;

each audio signature is associated with a fault type for an HVAC system; and each fault type is associated with a component identifier for a component of the HVAC system; and a processor operably coupled to the memory, configured to:

send to the HVAC system instructions to perform an operation that changes a temperature within a space, wherein the HVAC system comprises one or more components configured to perform the operation;

receive a first audio signal from a microphone while HVAC system performs the operation;

generate a representation of the first audio signal;

identify one or more audio signatures from the audio signature library, wherein the one or more audio signatures are associated with the one or more components of the HVAC system;

compare the one or more audio signatures to the representation of the first audio signal;

determine that an audio signature from among the one or more audio signatures is not present within the representation of the first audio signal;

determine a fault type that is associated with the audio signature that is not present within the representation of the first audio signal;

identify a first component identifier for a first component of the HVAC system that is associated with the fault type; and output the first component identifier.

18. The device of claim 17, wherein the processor is further configured to transition the microphone from an inactive state to an active state before operating the HVAC system, wherein:

the microphone is not configured to capture the first audio signal while in the inactive state; and the microphone is configured to capture the first audio signal while in the active state.

19. The device of claim 17, wherein the processor is further configured to:

detect a triggering event corresponding with a first fault for the HVAC system while operating the HVAC system; and transition the microphone from an inactive state to an active state in response to the triggering event, wherein:

the microphone is not configured to capture the first audio signal while in the inactive state; and the microphone is configured to capture the first audio signal while in the active state.

20. The device of claim 17, wherein outputting the first component identifier comprises sending the first component identifier to a device that is located outside of the space.

* * * * *